United States Patent [19]

Gillberg-LaForce et al.

[11] Patent Number: 4,569,974

[45] Date of Patent: Feb. 11, 1986

[54] PROCESS FOR THE SURFACE MODIFICATION OF POLYESTER MATERIAL AND THE POLYESTER MATERIAL SO MODIFIED

[75] Inventors: Gunilla E. Gillberg-LaForce, Summit; Ronald N. DeMartino, Wayne, both of N.J.

[73] Assignee: Celanese Corporation, New York, N.Y.

[21] Appl. No.: 705,157

[22] Filed: Feb. 25, 1985

[51] Int. Cl.[4] ..... C08F 283/00; C08G 63/76; C08L 67/00

[52] U.S. Cl. ..... 525/437; 528/272; 528/308.1; 528/308.2; 528/495

[58] Field of Search ..... 525/437; 528/272, 308.1, 528/308.2, 495

[56] References Cited

U.S. PATENT DOCUMENTS

| | | | |
|---|---|---|---|
| 3,935,169 | 1/1976 | Reen | 528/495 |
| 3,943,105 | 3/1976 | Hermes | 528/495 X |
| 4,215,032 | 7/1980 | Kabayashi et al. | 525/437 X |
| 4,277,584 | 7/1981 | Choi et al. | 528/272 X |
| 4,379,913 | 4/1983 | Waitkus | 528/272 X |
| 4,446,303 | 5/1984 | Moore et al. | 525/437 X |

*Primary Examiner*—Lucille M. Phynes

*Attorney, Agent, or Firm*—Burns, Doane, Swecker & Mathis

[57] ABSTRACT

Surface modification of polyester material is obtained by contacting the material in substantially non-crystallized form with a non-crystallizable oligomer. The oligomer has ester linkages and is prepared from a reaction mixture which includes at least one polyol having a functionality greater than three and selected from the group consisting of pentaerythritol, low molecular weight polymers of pentaerythritol, glycerol, low molecular weight polymers of glycerol and mixtures thereof. After contact with the oligomer, the polyester is crystallized. The modified polyester material exhibits improved properties such as hydrophilicity and/or adhesive bonding.

19 Claims, No Drawings

PROCESS FOR THE SURFACE MODIFICATION OF POLYESTER MATERIAL AND THE POLYESTER MATERIAL SO MODIFIED

BACKGROUND OF THE INVENTION

1. Field of the Invention

The present invention relates to a process for the surface modification of polyester material. The present invention also relates to polyester material which has been surface modified.

2. Description of the Prior Art

There have been numerous attempts in the art to modify polyester material, especially polyethylene terephthalate, so that it is more hydrophilic. For example, U.S. Pat. No. 3,619,276 discloses a process for improving the surface characteristics of polyester shaped articles by coating them with a polyester consisting of a polyoxyalkylene glycol, terephthalic acid or its functional derivative and ethylene glycol. A portion of the terephthalic acid or ethylene glycol may be replaced by an additional component such as difunctional carboxylic acids, alkylene glycols and polyfunctional hydroxy compounds. The coating allegedly improves the antistatic, soil resistance, hygroscopic, water-absorbing and moisture permeating properties of the polyester material.

A further attempt to modify polyester material is described in U.S. Pat. No. 3,416,952. As set forth herein, an essentially linear crystallizable shaped polyester article is treated with a water-insoluble crystallizable polymer compound comprising within a single molecule sufficient repeating units identical to those comprising the crystallizable portions of the polyester to co-crystallize with the same and at least one active group from a defined list of groups which serves to modify the surface of the shaped article. It is not essential that the polymer compound be applied to the surface of the shaped article in crystalline form, but can be applied in molten or dissolved form. It is also not essential that the shaped article be in crystalline form when the treating agent is applied to the surface of the polyester material. However, in those instances where neither the polymeric compound nor the shaped articles is in crystalline form, it is necessary for crystallinity to be developed for both subsequent to the treating process.

Other U.S. patents which describe the chemical modification of polyester material are U.S. Pat. Nos. 3,136,665, 3,310,512, 3,625,754, 3,928,230, 4,035,531 and 4,219,625.

Despite the numerous attempts in the art to modify polyester material so as to alter the characteristics thereof, there still exists a need for a surface modified polyester material with improved hydrophilicity and/or a greater reactivity for bonding using commonly known adhesive systems. The present invention is a result of research efforts in response to that need.

OBJECTS OF THE INVENTION

Accordingly, it is a general object of the present invention to meet the need for a surface modified polyester material.

It is a more specific object of the present invention to provide a polyester material which exhibits a higher degree of hydrophilicity.

It is a further object of the present invention to provide a polyester material which exhibits improved comfort, soil release and antistatic properties and dyeability.

It is a still further object of the present invention to provide a polyester material which has a higher reactivity for bonding by means of known adhesive systems.

SUMMARY OF THE INVENTION

In a first aspect, the present invention provides a process for the surface modification of polyester material. The process comprises:

(a) contacting polyester material having a crystallinity of less than about 15% with a non-crystallizable oligomer having a plurality of ester linkages and prepared from a reaction mixture comprised of at least one compound which includes the unit $$-\overset{O}{\overset{\|}{C}}-A-\overset{O}{\overset{\|}{C}}-$$

and at least one compound which includes the unit —O—B—O— wherein of the total number of units containing A in the reaction mixture, from about 85 to about 100% of the units contain an A which is a divalent group that is identical to the corresponding group in the polyester chain of the polyester material and wherein of the total number of units containing B, from about 9 to about 91 contain a B which is a divalent group that is compatible with the corresponding group in the polyester chain of the polyester material and from about 91 to about 9% of the units contain a B which is derived from at least one polyol having a hydroxy functionality of greater than 3 and selected from the group consisting of pentaerythritol, a low molecular weight polymer of pentaerythritol, glycerol, a low molecular weight polymer of glycerol and mixtures thereof;

(b) crystallizing said polyester material; and (c) recovering said crystallized modified polyester material.

In another aspect, the present invention provides surface modified, crystallized, polyester material having improved properties.

DETAILED DESCRIPTION OF THE INVENTION

As mentioned hereinabove, one aspect of the present invention relates to a process for modifying the surface of polyester material. As used herein, the term "polyester" is intended to include, but not be limited to, high molecular weight linear polyesters obtained from at least one aliphatic, cycloaliphatic or aromatic diol and at least one aliphatic, cycloaliphatic or aromatic dicarboxylic acid. Illustrative polyesters may be prepared by reacting one or more glycols of the series $HO(CH_2)_nOH$ wherein n ranges from 2 to 6 with one or more dicarboxylic acids such as naphthalene dicarboxylic acid, 4,4'diphenyl dicarboxylic acid or terephthalic acid. The preferred polyester consists essentially of polyethylene terephthalate which is conventionally obtained from ethylene glycol and either terephthalic acid or dimethyl terephthalate or from the homopolymerization by alcoholysis of bis(hydroxyethyl)terephthalate. These and other mechanisms are described by M. P. Stevens in "Polymer Chemistry" (1975), the contents of which is incorporated by reference. It is therefore apparent that the polyesters which may be used to form the material and their preparation are well known in the art as may additionally be seen from the patents mentioned in the description of the prior art whose contents are also incorporated by reference.

The material into which the polyester is formed can be any size and configuration depending upon the ultimate use of the material. The material can therefore be filaments, yarns, cords, fabrics and films. Such material can be further processed into such items as tire cord or fabrics and apparel, particularly those made from staple fibers, and which may or may not be blended with other synthetic or natural fibers.

To impart the improved properties to the polyester material, the material is contacted with a non-crystallizable oligomer. Like the polyester material to which it is applied, the oligomer has ester linkages which result from the reaction of a dicarboxylic acid and a compound bearing hydroxyl groups. It should be apparent that the oligomer may also be prepared by comparable techniques such as ester interchange or diol interchange (e.g., glycol interchange when the polyester materials is polyethylene terephthalate and bis(hydroxyethyl)-terephthalate is reacted with the hydroxyl bearing compound to form the oligomer).

The dicarboxylic acid or its derivative (e.g., dimethyl terephthalate or bis(hydroxyethyl)terephthalate for polyethylene terephthalate material) hereafter collectively referred to as the "dicarboxylic acid compound" is selected such that it is identical to or compatible with the dicarboxylic acid compound of the polyester material. In other words, the dicarboxylic acid compound may be represented by

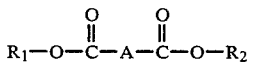

wherein $R_1$ and $R_2$ can be hydrogen, lower alkyl or hydroxyl lower alkyl, and wherein A is selected such that it is identical to the corresponding A in the polyester material. The dicarboxylic acid compound may also include a small amount of a further reactive compound which may be selected to modify the properties imparted by the oligomer to the polyester material, but the further compound should not substantially adversely affect the desired result of improved hydrophilicity.

The hydroxyl bearing compound which is reacted with the dicarboxylic acid compound is selected depending on the dicarboxylic acid compound employed. If the dicarboxylic acid acid compound already contains reactive end groups which are identical or completely compatible with the hydroxyl bearing compound used in the preparation of the polyester material (e.g., bis(hydroxyethyl)terephthalate when the material is polyethylene terephthalate), then the hydroxyl bearing compound may consist essentially of at least one polyol as will subsequently be defined. On the other hand, if the dicarboxylic acid compound does not contain such reactive end groups, the hydroxyl bearing compound must include a compound which will result in an ester unit which is compatible (i.e., identical or functionally able to be incorporated into polyester material) with the ester unit in the polyester material.

The oligomer will have a plurality of ester linkages and will be prepared from a reaction mixture comprised on at least one compound which includes the unit

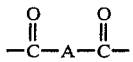

and at least one compound which includes the unit —O—B—O—, wherein of the total number of units containing A in the reaction mixture, from about 85 to about 100%, preferably from about 95 to about 100% of the units contain an A which is a divalent group that is identical to the corresponding group in the polyester chain of the polyester material and wherein of the total number of units containing B, from about 9 to about 91%, preferably from about 50 to about 90% of the units contain a B which is a divalent group that is compatible with the corresponding group in the polyester chain of the polyester material and from about 91 to about 9%, preferably from about 50 to about 10% of the units contain a B which is derived from at least one polyol having a hydroxy functionality of greater than 3 and selected from the group consisting of pentaerythritol, low molecular weight polymers of pentaerythritol, glycerol, low molecular weight polymers of glycerol, and mixtures thereof. The preferred polyols are the low molecular weight polymers of pentaerythritol and the low molecular weight polymers of glycerol and the most preferred polyols are the low molecular weight polymers of glycerol.

Low molecular weight polymers of pentaerythritol typically have a molecular weight of from about 136 to about 490 and are exemplified by dipentaerythritol, tripentaerythritol, tetrapentaerythitol and mixtures thereof.

Low molecular weight polymers of glycerol typically have a molecular weight of from about 92 to about 760, and are exemplified by triglycerol, hexaglycerol, decaglycerol, and mixtures thereof.

As should be apparent from the description of the polyester which is used to form the polyester material, A may be a divalent group which is identical to the corresponding group (i.e., located between the two carbonyl groups) present in the aliphatic, cycloaliphatic or aromatic dicarboxylic acid exemplified by naphthalene dicarboxylic acid, 4,4'diphenyl dicarboxylic acid, terephthalic acid or dimethyl terephthalate used to prepare the polyester. Similarly, to form at least one ester unit which is compatible with the polyester material, a portion of the B groups may be identical or functionally equivalent to the corresponding group (i.e., located between the two oxy groups) present in the aliphatic, cycloaliphatic or aromatic diols exemplified by glycols of the series $HO(CH_2)_nOH$ wherein n ranges from 2 to 6 used to prepare the polyester. Of course, where a compound such as bis(hydroxyethyl)terephthalate is used (and the polyester material is polyethylene terephthalate), this single compound can be the source of both units since it contains both A and B groups. In instances when such a compound containing A and B groups is used and with the understanding that the compound will contribute toward the total number of both units (e.g., one unit containing A and two units containing B), it will be appreciated that the foregoing percentages are identical to molar percentages.

To further improve wettability and/or stain release properties, small amounts, namely from about 1 to about 15 mole percent, preferably from about 1 to about 5 mole percent of additional components may be used to form the oligomer. For example, when the polyester material is composed of polyethylene terephthalate, dimethyl sulfoisophthalate, 5-sulfoisophthalic acid, polyethylene glycol having a molecular weight ranging from about 200 to about 8,000 and mixtures thereof may be present in the reaction mixture used to form the oligomer.

As will be apparent from the examples set forth below, the reaction mixture need not contain a stoichiometric ratio between the units containing the A and B groups. To the extent that an excess of components is used, however, the excess is comprised of one or more compounds containing the B groups (i.e., compounds containing hydroxyl groups). The presence of such excess does not appear to adversely affect the function of the oligomer so that is may be present when the oligomer is contacted with the polyester material and then may be subsequently removed (e.g., after the polyester material is crystallized).

As indicated above, the non-crystallizable oligomer may be prepared via a polyol interchange or, if the polyester compatible compound is formed in situ, an ester interchange. The reaction is typically conducted under an inert atmosphere at a temperature ranging from about 150° to about 250° C. for about 1 to about 6 hours in the presence of known ester interchange catalysts. Such catalysts include the carbonates, oxides, alkanoates or alkoxides of metals such as antimony, barium, cadmium, calcium, cobalt, lead, magnesium, manganese, titanium, zinc, and mixtures thereof. In the event that a catalyst, such as $Mg/Ti—(OC_4H_9)_4$, which requires the use of anhydrous conditions, the polyol can be refluxed overnight in an organic solvent, such as toluene, to remove all traces of water.

As used herein, the requirement that the oligomer be non-crystallizable means crystallinity cannot be detected using a differential scanning calorimeter under standard conditions. Typically, the oligomer is in the form of a viscous liquid resembling a syrup or oil or is a waxy solid.

The oligomer has a molecular weight of from about 1,000 to about 50,000, preferably from about 5,000 to about 20,000 as determined by gel permeation chromatography under standard conditions and is substantially branched. However, the oligomer typically has less than about 1, preferably less than about 0.1 percent cross-linking.

The polyester material is contacted with the oligomer when the polyester has less than about 15% crystallinity, as determined by a differential scanning calorimeter under standard conditions. In the event that the polyester material is prepared from the melt, contact with the oligomer may conveniently be conducted as the material is formed and before it is substantially drawn or heated such that crystallization occurs. Preferably, contacting is performed at a temperature near the glass transition temperature of the polyester in order to achieve integration of the oligomer with the polyester in a conveniently short period of time. Depending on the specific material prepared, contacting may be achieved by using pad rolls, kiss rolls, sprays, baths or metered applicators whereby the material is fully wet with a solution, dispersion or foam containing the oligomer. The concentration of the oligomer depends upon the manner in which it is to be applied to the polyester material. In those instances where a high pick-up results from the contacting technique, such as with a bath in which the material is immersed, the oligomer may be present in lower concentrations (e.g., from about 0.1 to about 0.5 weight percent) than in those instances where a lower pick-up results.

To illustrate the foregoing principles, in the preparation of yarn from molten polyester which yarn is then further processed into staple fibers, the oligomer may constitute from about 5 to about 95%, preferably from about 10 to about 50% by weight calculated on an oil basis (i.e., based on solids) of the spin finish. Of course, as is apparent to those of ordinary skill in the art, this spin finish may also contain conventional ingredients, such as lubricants, anti-static agents, emulsifying agents, and other components in known amounts. A more specific description of staple fiber processing equipment and conventional ingredients in the spin finish may be found in commonly assigned, pending application Ser. No. 397,295, by G. C. Gabbrielli filed on July 12, 1982 and entitled "Improved Hydrophilic Polyester Staple Fiber, Method of Production Thereof and Fabric Produced Therefrom," the contents of which are incorporated by reference.

It should likewise be apparent that the oligomer can be applied to the polyester material in a separate spray before, during or after the application of a conventional finish. In this instance, the oligomer may be dispersed in a mixture of water and one or more organic solvents, such as ethanol, isopropanol, methanol, acetone, dimethyl sulfoxide, dimethyl formamide and other highly polar solvents. It will be appreciated that solvents which might cause solvent induced crystallization of the polyester should be avoided or used under conditions which minimize crystallization at the application conditions. Dispersion of the oligomer may be achieved with or without a dispersing agent, such as a block copolymer of polyethylene glycol and polypropylene glycol, or may be dispersed or dissolved in an organic solvent. The dispersion or solution is selected such that the oligomer does not precipitate or react therein and may be applied to the polyester material in a uniform manner.

It is preferred that the oligomer be applied in an aqueous or other polar media since it believed that contacting the polyester material causes an orientation of the oligomer such that polyester compatible portions are near the surface of the polyester while the portions resulting from the polyol face away from the surface. Such orientation may help explain the beneficial surface modification obtained by the present invention.

The oligomer may also be applied to polyethylene terephthalate yarn which is to be further processed into staple fibers in the pre-draw frame bath or as a separate bath at this point of the process. The oligomer constitutes from about 5 to about 95% by weight of the bath calculated on an oil basis which is normally maintained at a temperature in a range from about 50° to about 100° C. which is near the glass transition temperature of the polyethylene terephthalate.

Polyethylene terepthalate yarn which is to be fabricated into reinforcing material (e.g., cord) in the preparation of reinforced rubber-based materials such as pneumatic tires, conveyer belts, hoses, transmission belts, raincoats and the like, may also be contacted with the oligomer as part of the spin finish or as a separate solution or dispersion. In either event, the oligomer may be applied via the use of a kiss roller, spray, foam, metered applicator or bath. The concentration of the oligomer and other components of the dispersion or solution may be selected depending on the particular means of application.

The manner of applying the oligomer to the material is in large part dependent on the configuration and end use of the material, but in all cases is applied such that the oligomer constitutes from about 0.01 to about 5%, preferably from about 0.1 to about 1% of the polyester material on a weight to weight basis.

Penetration of the oligomer into the surface of the polyester material is relatively rapid so that the residence time of the oligomer on the surface of the polyester material can be short. Typically, the residence time may range from about 0.1 to about 10 seconds, preferably from about 0.1 to about 3 seconds. The residence time needed to obtain adequate penetration into the surface of the polyester material is affected by the temperature with higher temperatures resulting in shorter residence times.

After the polyester material has been contacted with the oligomer, it is treated to obtain the desired level of crystallinity. This is generally achieved by drawing (i.e., stretching) and/or heating the material to obtain a degree of crystallinity which typically ranges from about 35 to about 60 percent as determined by a differential scanning calorimeter under standard conditions. Crystallization of the polyester material is believed to "lock" the ester units of the oligomer which are compatible with the polyester material into the surface thereof with the portions of the oligomer resulting from the polyol protruding from the surface of the material. It is this phenomenon which is believed to be responsible for the improved hydrophilicity of the surface modified polyester material of the present invention. The improved hydrophilicity, which may be quite durable, can also result in improved stain release properties, reduced susceptability to static electricity, improved dyeability and improved bonding when using most adhesive systems, such as resorcinol-formaldehyde latex types of adhesives.

After the polyester material is subjected to crystallization, it is recovered such as by winding on a spool or spindle. It may also be optionally rinsed or washed (e.g., using an aqueous spray or bath) to remove any excess oligomer and hydroxyl bearing compounds and may be further processed according to conventional process steps depending on the ultimate use of the material. For example, polyester yarn which is to be processed into staple fibers may be first formed into a sub-tow. A plurality of such sub-tows (e.g., from about 20 to about 22) are combined to form a creel which is passed through a predraw frame bath which is followed by a draw frame typically having three septets of horizontal rolls with or without the presence of surface finish sprays and heat treatment application. The drawn yarn may then be subjected to a post-draw spray, passed through a crimper, passed through a hot air oven and cut to a predetermined length which is generally from about 1 to about 3 inches in length. The staple fibers may then be processed into yarn and the yarn into fabric with or without blending with other synthetic or natural yarns.

Alternatively, if the polyester material is to be formed into tire cord, the polyester yarn may be twisted into cords which are then treated with an adhesive composition and incorported into rubber products. The preparation of highly crystalline and highly stressed yarn which is especially suitable for this application is set forth in U.S. Pat. No. 4,414,169, the contents of which are incorporated by reference.

With some polyester material, such as polyester films, the effect of the oligomer may be improved by treating the material with a crazing solvent, such as acid, before it is treated with the oligomer solution or dispersion. The crazing solvent is believed to cause the formation of shallow cavities in the material which may create new locations for contacting with the oligomer.

The following Comparative and Inventive Examples are set forth to illustrate the present invention. It should be understood, however, that the invention is not limited to the specific details set forth in the Inventive Examples.

PREPARATION OF THE OLIGOMERS

A: Ester Interchange

To a 300 ml 3 necked flask fitted with a mechanical stirrer, argon inlet and distillation head/condenser is added the following:

| | |
|---|---|
| Dimethyl terephthalate | 48.5 g (0.25 moles) |
| Ethylene glycol | 11.0 g (0.18 mole) |
| Decaglycerol | 53.0 g (0.07 mole) |
| Potassium carbonate | 0.2 g |

Under a stream of argon gas, the flask is placed in an oil bath which is subsequently heated to 140° C. After a brief induction period, methanol begins to distill off. The reaction is held at 140° C. for one hour and the temperature is then raised to 160° C. for an additional hour. At this time, the temperature is raised to 180° C. and is held there until 15 milliliters of methanol (75% of theoretical) is collected. This takes approximately 4 additional hours.

The reaction mixture is cooled down to 100° C. and the oil-like product is poured into a jar and allowed to cool to room temperature. The product is tested without further purification.

B: Glycol Interchange

To the same apparatus identified in A is added the following:

| | |
|---|---|
| Bis(hydroxyethyl) terephthalate | 127 g (0.5 mole) |
| Decaglycerol | 120 g (0.158 mole) |
| Antimony oxide | 0.1 g |

Under a stream of argon gas, the flask is heated to 250° C. and is held at this temperature for a period of 4 hours. During this time, 15 ml of glycol (55% of theoretical) distills off. The flask is cooled to 100° C. and the oil-like product is poured into a jar and cooled to room temperature. The product is used without further purification.

It should be apparent that other oligomers can likewise be prepared by using the same or similar techniques. For example, dimethyl terephthalate, dimethyl sulfoisophthalate, ethylene glycol and decaglycerol in a molar ratio of 0.9/0.1/0.75/0.25 may be reacted in the presence of potassium carbonate according to the process described in A for a total reaction time of 8 hours such that 11 milliliters of methanol is collected. Similarly, dimethyl terephthalate, ethylene glycol, polyethylene glycol 400 and decaglycerol in a molar ratio of 1/0.65/0.1/0.25 may be reacted in the presence of potassium carbonate following the process described in A with a total reaction time of 6 hours such that 12 milliliters of methanol is distilled off.

The process of A may also be used to react dimethyl terephthalate, dimethyl sulfoisophthalate, ethylene gylcol, polyethylene glycol 400 and decaglycerol in a molar ratio of 0.9/0.1/0.65/0.1/0.25 in the presence of potassium carbonate for a reaction time of 8 hours such that 11 milliliters of methanol may be collected.

In some instances, the order of addition of the reactants, especially the hydroxyl bearing compound, can lead to an improvement in the hydrophilic properties imparted to the polyester material. For example, where two or more compounds are used as the hydroxyl bearing compound, it may be preferable to add the defined polyol after the other compounds have been added to the reaction mixture.

In the event that excess hydroxyl bearing compound is employed, at least a portion of any volatile hydroxyl bearing compound (e.g., ethylene glycol) may be distilled off. Care should be taken, however, that excessive cross-linking does not occur. Any remaining unreacted material may be used in conjunction with the oligomer in order to treat the polyester material. Of course, such unreacted material may be separated from the oligomer product before the oligomer is used to treat the polyester material.

CONTACTING THE POLYESTER MATERIAL WITH THE OLIGOMER

Melt spun polyethylene terephthalate yarn having a degree of crystallinity of about 7.8% as determined by a differential scanning calorimeter under standard conditions is contacted with a solution of the oligomer via the use of a spin finish belt. The solution contains about one percent by weight of the oligomer and may also contain a small amount of a surfactant. The yarn has a pick up of about 100% so that the oligomer constitutes approximately 1% of the yarn on a weight to weight basis.

Some of the oligomers are found to be insoluble in the solution. However, solubility is not an essential criterion since such oligomers can be dispersed in a mixture of water and organic solvent optionally with a dispersing agent. The treated yarn is fed over a hot shoe at 100° C. to allow penetration of the oligomer without extensive crystallization of the polyester. The yarn is subsequently fed over a second hot shoe at 150° C. and a 2.5:1 draw to complete crystallization. The final yarn speed is 32.5 m/min. After this step, the yarn is fed onto a Leesona Winder. Coning oil is added through a metered pump to facilitate knitting into a hose leg fabric.

The fabric is washed for 5 or 15 times with an ordinary washing machine using a commercially available laundry detergent. Wettability is measured by placing 2 milliliters of water on the fabric and determining the number of seconds until the water is absorbed. An improvement in wettability is obtained when the absorption time is less than about 1500 seconds, preferably less than about 1000 seconds.

Stain release is measured by staining a small swatch of fabric with 5 drops of a standard dirty motor oil, allowing the fabric to equilibrate for 1 hour and then laundering the swatch once. The swatch is then evaluated against a standard rating scale ranging from 1 (poor) to 5 (excellent). An improvement in stain release is obtained with a rating of at lease 1.5 and a stain release rating of at least 2.0 is preferred.

The results of wettability and stain release studies with various oligomers is set forth in the following Tables I–VI.

TABLE I

| Pentaerythritol Oligomers | | | | |
|---|---|---|---|---|
| Example | Monomers | Starting Mole Ratio | Wet-tability 5 Wash | Stain Release 5 Wash |
| Comp. 1 | DMT/P | 1/2 | 2000 | 1.0 |
| Inv. 1 | DMT/EG/P | 1/.5/1.5 | 1066 | 1.0 |
| Inv. 2 | DMT/EG/P | 1/.25/.75 | 2000 | 1.0 |
| Inv. 3 | DMT/EG/P | 1/.5/.5 | 2000 | 1.0 |
| Inv. 4 | DMT/DMSI/EG/P | .9/.1/1/1 | 241 | 0.5 |
| Inv. 5 | DMT/DMSI/EG/PEG/P | .75/.25/1.25/1 | Not soluble | |
| Inv. 6 | DMT/EG/PEG/P | 1/2/1/1 | 558 | 1.0 |
| Inv. 7 | BHET/PEG-600/P | 1/1/1 | 1083 | 0.5 |
| Inv. 8 | BHET/PEG-600/P | 1/.25/1 | Not soluble | |
| Inv. 9 | BHET/PEG-200/P | 1/.25/1 | Not soluble | |
| Inv. 10 | DMT/PEG-600/P | 1/.5/.5 | 484 | 1.0 |

DMT = dimethyl terephthalate
P = pentaerythritol
EG = ethylene glycol
DMSI = dimethyl sulfoisophthalate
PEG = polyethylene glycol
BHET = bis(hydroxyethyl) terephthalate

TABLE II

| Dipentaerythritol and Tripentaerythritol Oligomers | | | | | | |
|---|---|---|---|---|---|---|
| | | Starting | Wettability | | Stain Release | |
| Example | Monomers | Mole Ratio | 5 Wash | 15 Wash | 5 Wash | 15 Wash |
| | | Dipentaerythritol | | | | |
| Comp. 2 | DMT/Dip | 1/1 | 271 | — | 1.0 | — |
| Inv. 11 | DMT/EG/Dip | 1/1.5/0.5 | 334 | — | 1.5 | — |
| Inv. 12 | DMT/EG/Dip | 1/1.5/0.5 | 1402 | — | 2.0 | — |
| Inv. 13 | DMT/EG/Dip | 1/1/1 | Not soluble | | | |
| Inv. 14 | DMT/EG/Dip | 1/0.5/1.5 | Not soluble | | | |
| Inv. 15 | DMT/EG/Dip | 1/.25/.75 | Not soluble | | | |
| Inv. 16 | DMT/DMSI/EG/Dip | .9/.1/1.5/.5 | 136 | 129 | 3.0 | 1.0 |
| Inv. 17 | DMT/DMSI/EG/Dip | .8/.2/1.5/.5 | 126 | 300 | 1.0 | — |
| Inv. 18 | DMT/DMSI/EG/Dip | .8/.2/1/1 | 619 | — | 0.5 | — |
| Inv. 19 | DMT/DMSI/EG/PEG-600/Dip | .8/.2/1/.5/.5 | 1098 | — | 1.0 | — |
| Inv. 20 | BHET/PEG-600/Dip | 1/1/1 | 1609 | — | 1.0 | — |
| Inv. 21 | BHET/PEG-600/Dip | 1/.25/1 | Not soluble | | | |
| | | Tripentaerythritol | | | | |
| Inv. 22 | DMT/EG/Tri | 1/1.5/.5 | 122 | — | 1.5 | — |
| Inv. 23 | DMT/DMSI/EG/Tri | .9/.1/1.5/.5 | 219 | 423 | 3.0 | 1.5 |

TABLE II-continued

| Dipentaerythritol and Tripentaerythritol Oligomers | | | | | | |
|---|---|---|---|---|---|---|
| | | Starting | Wettability | | Stain Release | |
| Example | Monomers | Mole Ratio | 5 Wash | 15 Wash | 5 Wash | 15 Wash |
| Inv. 24 | DMT/DMSI/EG/Tri | .9/.1/1.5/5 | 186 | — | 3.0 | — |

Dip = dipentaerythritol
Tri = tripentaerythritol

TABLE III

| Glycerol Oligomers | | | | |
|---|---|---|---|---|
| Example | Monomers | Starting Mole Ratio | Wettability 5 Wash | Stain Release 5 Wash |
| Comp. 3 | DMT/G | 1/2 | 2000 | 1.0 |
| Inv. 25 | DMT/EG/G | 1/.5/1.5 | 1927 | 1.0 |
| Inv. 26 | DMT/EG/G | 1/1/1 | 2000 | 1.0 |
| Inv. 27 | DMT/EG/G | 1/.25/.75 | Not soluble | |
| Inv. 28 | DMT/EG/G | 1/.5/.5 | Not soluble | |
| Inv. 29 | DMT/DMSI/EG/G | .9/.1/1/1 | 395 | 0.5 |

G = glycerol

TABLE IV

| Triglycerol Oligomers | | | | | | |
|---|---|---|---|---|---|---|
| | | Starting | Wettability | | Stain Release | |
| Example | Monomers | Mole Ratio | 5 Wash | 15 Wash | 5 Wash | 15 Wash |
| Inv. 30 | BHET/TG | 1/1 | 157 | 233 | 3.0 | 1.5 |
| Inv. 31 | BHET/TG | 1/1 | 638 | — | 1.0 | — |
| Inv. 32 | BHET/TG | 1/1 | 155 | 228 | 1.0 | 1.0 |
| Inv. 33 | DMT/EG/TG | 1/1/1 | 2952 | — | 1.0 | — |
| Inv. 34 | DMT/DMSI/EG/TG | .8/.2/1/1 | 2346 | — | 1.0 | — |

TG = triglycerol

TABLE V

| Decaglycerol Oligomers | | | | | | |
|---|---|---|---|---|---|---|
| | | Starting Mole | Wettability | | Stain Release | |
| Example | Monomers | Ratio | 5 Wash | 15 Wash | 5 Wash | 15 Wash |
| Inv. 35 | BHET/DG | 1/0.6 | 1389 | — | 1.0 | — |
| Inv. 36 | BHET/DG | 1/0.6 | 2000 | — | 1.0 | — |
| Inv. 37 | BHET/DG | 1/0.3 | 277 | — | 3.5 | 2.5 |
| Inv. 38 | BHET/DG | 1/0.2 | 2103 | — | 3.0 | 2.0 |
| Comp. 3 | DMT/DG | 1/1 | 1500 | — | 1.0 | — |
| Inv. 39 | DMT/EG/DG | 1/.75/.25 | 87 | 489 | 3.0 | 2.5 |
| Inv. 40 | DMT/EG/DG | 1/.5/.5 | 1320 | — | 2.0 | 1.0 |
| Inv. 41 | DMT/EG/DG | 1/.25.75 | 1652 | — | 1.0 | — |
| Comp. 4 | DMT/PEG-400/DG | 1/.75/.25 | 1678 | — | 1.0 | — |
| Comp. 5 | DMT/PEG-400/DG | 1/.5/.5 | 2000 | — | 1.0 | — |

DG = decaglycerol

TABLE VI

| Decaglycerol Oligomers | | | | | | |
|---|---|---|---|---|---|---|
| | | Starting Mole | Wettability | | Stain Release | |
| Example | Monomers | Ratio | 5 Wash | 15 Wash | 5 Wash | 15 Wash |
| Inv. 42 | DMT/EG/DG | $1/.75^1/.25^2$ | 870 | — | 1.0 | — |
| Inv. 43 | DMT/EG/DG | $1/.75^1/.25^1$ | 940 | — | 2.5 | — |
| Inv. 44 | DMT/EG/DG | $1/.5^1/.5^2$ | 684 | — | 2.0 | 1.0 |
| Inv. 45 | DMT/EG/DG | $1/.5^2/.5^1$ | 2084 | — | 1.0 | — |
| Comp. 6 | DMT/PEG-400/DG | $1/.75^1/.75^2$ | 1955 | — | 1.0 | — |
| Comp. 7 | DMT/PEG-400/DG | $1/.75^2/.75^1$ | 1003 | — | 1.0 | — |
| Comp. 8 | DMT/PEG-400/DG | $1/.5^1/.5^2$ | 953 | — | 1.0 | — |
| Comp. 9 | DMT/PEG-400/DG | $1/.5^2/.5^1$ | 2000 | — | 1.0 | — |
| Inv. 46 | DMT/EG/PEG-1000/DG | 1/.5/.25/.25 | 2000 | — | 1.0 | — |
| Inv. 47 | DMT/EG/PEG-400/DG | 1/.5/.25/.25 | 221 | — | 1.0 | — |
| Inv. 48 | DMT/EG/PEG-400/DG | $1/.5^3/.25^1/.25^2$ | 1034 | — | 1.0 | — |
| Inv. 49 | DMT/EG/PEG-400/DG | 1/.375/.375 .25 | 1460 | — | 3.0 | 2.0 |
| Inv. 50 | DMT/EG/PEG-400/DG | $1/.375^3/.375^1/.25^2$ | 460 | — | 2.5 | — |
| Inv. 51 | DMT/EG/DG | 1/.65/.35 | 253 | 1143 | 2.5 | 2.0 |
| Inv. 52 | DMT/EG/PEG-1000/DG | 1/.65/.1/.25 | 1380 | — | 1.0 | — |
| Inv. 53 | DMT/EG/PEG-400/DG | 1/.65/.1/.25 | 533 | 1606 | 3.5 | 3.0 |
| Inv. 54 | DMT/DMSI/EG/DG | .9/.1/.75/.25 | 738 | 1434 | 2.5 | 2.0 |
| Inv. 55 | DMT/DMSI/EG/PEG-400/DG | .9/.1 .65/.1 .25 | 647 | — | 1.0 | — |
| Inv. 56 | DMT/DMSI/ | .9/.1/ | 2000 | — | 1.0 | — |

TABLE VI-continued

| | | Decaglycerol Oligomers | | | | |
|---|---|---|---|---|---|---|
| | | Starting Mole | Wettability | | Stain Release | |
| Example | Monomers | Ratio | 5 Wash | 15 Wash | 5 Wash | 15 Wash |
| | EG/PEG-400/DG | .5/.25/.25 | | | | |
| Inv. 57 | DMT/DMSI | .9/.1/ | 1659 | — | 1.0 | — |
| | EG/PEG-400/DG | .375/.375/.25 | | | | |

Superscripts indicate order of addition to the reaction mixture.

Although the invention has been described with preferred embodiments, it is to be understood that variations and modifications may be employed as will be apparent to those skilled in the art. Such variations and modifications are to be considered within the purview and scope of the claims appended hereto.

We claim:

1. A process for the surface modification of polyester material comprising:

(a) contacting polyester material having a crystallinity of less than about 15% with a non-crystallizable oligomer having a plurality of ester linkages and prepared from a reaction mixture comprised of at least one compound which includes the unit

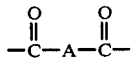

and at least one compound which includes the unit —O—B—O— wherein of the total number of units containing A in the reaction mixture, from about 85 to about 100% of the units contain an A which is a divalent group that is identical to the corresponding group in the polyester chain of the polyester material and wherein of the total number of units containing B, from about 9 to about 91 contain a B which is a divalent group that is compatible with the corresponding group in the polyester chain of the polyester material and from about 91 to about 9% of the units contain a B which is derived from at least one polyol having a hydroxy functionally of greater than three and selected from the group consisting of pentaerythritol, low molecular weight polymers of pentaerythritol, glycerol, low molecular weight polymers of glycerol and mixtures thereof;

(b) crystallizing said polyester material; and (c) recovering said crystallized modified polyester material.

2. The process of claim 1 wherein the polyester material is polyethylene terephthalate.

3. The process of claim 2 wherein the polyethylene terephthalate is melt spun.

4. The process of claim 1 wherein the oligomer has a molecular weight in the range of from about 1,000 to about 50,000.

5. The process of claim 4 wherein the oligomer has a molecular weight in the range of from about 5,000 to about 20,000.

6. The process of claim 1 wherein the low molecular weight polymers of pentaerythritol have a molecular weight in the range of from about 136 to about 490 and the low molecular weight polymers of glycerol have a molecular weight in the range of from about 92 to about 760.

7. The process of claim 1 wherein of the total number of units containing A in the reaction mixture, from about 95 to about 100% of the units contain an A which is a divalent group that is identical to the corresponding group in the polyester chain of the polyester material and of the total number of units containing B, from about 90 to about 50% contain a B which is a divalent group that is compatible with the corresponding group in the polyester chain of the polyester material and from about 10 to about 50% of the units contain a B which is derived from said at least one polyol.

8. The process of claim 1 wherein the contacting is performed by applying a spin finish containing said oligomer.

9. The process of claim 4 wherein the spin finish contains from about 5 to about 95% by weight of the oligomer on an oil basis.

10. The process of claim 1 wherein the polyester material is selected from the group consisting of filaments, fabric and yarn.

11. The process of claim 1 wherein crystallizing is performed by drawing.

12. The process of claim 1 wherein crystallizing is performed by heating.

13. The process of claim 1 wherein crystallizing is performed by drawing and heating.

14. The process of claim 1 wherein the polyester material is polyethylene terephthalate and from about 85 to about 100% of the A units contain an A which is 1,4 phenylene and from about 9 to 91% of the B units contain a B which is a divalent ethylene radical.

15. A surface modified, crystallized, polyester material wherein said surface modification is obtained by contacting the polyester material in substantially non-crystallized form with a non-crystallizable oligomer having a plurality of ester linkages and prepared from a reaction mixture comprised of at least one compound which includes the unit

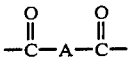

and at least one compound which includes the unit —O—B—O— wherein of the total number of units containing A in the reaction mixture, from about 85 to about 100% of the units contain an A which is a divalent group that is identical to the corresponding group in the polyester chain of the polyester material and wherein of the total number of units containing B, from about 9 to about 91 contain a B which is a divalent group that is compatible with the corresponding group in the polyester chain of the polyester material and from about 91 to about 9% of the units contain a B which is derived from at least one polyol having a hydroxy functionality of greater than three and selected from the group consisting of pentaerythritol, low molecular weight polymers of pentaerythritol, glycerol, low molecular weight polymers of glycerol and mixtures thereof wherein the polyester material is subsequently crystallized.

16. The surface modified, crystallized, polyester material of claim 15 wherein the polyester is polyethylene terephthalate and from about 85 to about 100% of the A units contain an A which is 1,4 phenylene and from about 9 to 91% of the B units contain a B which is a divalent ethylene radical.

17. The surface modified, crystallized polyester material of claim 15 wherein the polyol is selected form the group consisting of low molecular weight polymers of pentaerythritol, low molecular weight polymers of glycerol and mixtures thereof.

18. The surface modified, crystallized, polyester material of claim 16 wherein the material has a wettability indicated by an absorption time of less than about 1500 seconds.

19. The surface modified, crystallized, polyester material of claim 16 wherein the material has a wettability indicated by an absorption time of less than about 1000 seconds.

* * * * *